United States Patent [19]

Maye et al.

[11] Patent Number: 4,884,836

[45] Date of Patent: Dec. 5, 1989

[54] PLATE LIFTING CLAMP

[75] Inventors: David Maye, West Hempstead; Moon Choung, Melville, both of N.Y.

[73] Assignee: Cooper Industries, Inc., Houston, Tex.

[21] Appl. No.: 230,815

[22] Filed: Aug. 9, 1988

[51] Int. Cl.[4] ..... B66C 1/48

[52] U.S. Cl. ..... 294/101; 294/104

[58] Field of Search ..... 294/101, 104, 106, 110.1, 294/114, 116–118

[56] References Cited

U.S. PATENT DOCUMENTS

| | | | |
|---|---|---|---|
| 126,818 | 5/1872 | Lindsay | 294/118 X |
| 2,370,411 | 2/1945 | Monaco | 294/104 |
| 2,852,300 | 9/1958 | Gardner | 294/104 |
| 3,071,406 | 1/1963 | Lucker | 294/104 |
| 3,297,354 | 1/1967 | Renfroe | 294/104 |
| 3,857,600 | 12/1974 | Hasegawa | 294/101 X |
| 3,923,333 | 12/1975 | Whaley | 294/104 |
| 4,113,298 | 9/1978 | Kopp | 294/101 X |
| 4,162,804 | 7/1979 | Davies | 294/101 |

FOREIGN PATENT DOCUMENTS

| | | | |
|---|---|---|---|
| 2416189 | 10/1979 | France | 294/101 |

*Primary Examiner*—Johnny D. Cherry

*Attorney, Agent, or Firm*—David A. Rose; Donald J. Verplancken

[57] ABSTRACT

The plate lifting clamp of the present invention includes linkage disposed on the clamp with one end of the linkage connected to the lifting shackle and the other end of the linkage connected to a cam rotatably mounted on the clamp. A spring on the linkage causes the cam to rotate against the work piece gripping the work piece between the cam and a swivel pad mounted on the clamp. A further force is applied to the rotation of the cam as the work piece is lifted on the lifting shackle by the hoist. An operating handle is rotatably disposed on the clamp whereby when rotated to the open position, will cause the cam to rotate away from the work piece and open the clamp. A spring biased locking mechanism is provided on the clamp to lock the operating handle into the open position.

12 Claims, 3 Drawing Sheets

PLATE LIFTING CLAMP

BACKGROUND OF THE INVENTION

This invention relates to clamps for the lifting of steel plate and, more particularly, to a plate lifting clamp without a neutral position which can be released from gripping the plate and locked open from a position remote from the clamp.

Hoists are used to lift heavy steel plate in steel warehouses or similar type operations. A lifting clamp, connected to the hoist, is used to grip the edge of the steel plate to permit the steel plate to be lifted by the hoist for transporting the plate in the warehouse. See, for example, U.S. Pat. Nos. 4,491,358 and 4,702,508.

Many prior art clamps are locked closed and open by lever operation. All lever operated clamps have a neutral position between the locking and unlocking positions of the operating lever. Because such prior art lever operated clamps have a neutral position, the operator is able to place the clamp into the neutral position while the clamp is suspending a steel plate from its lifting shackle. Whenever the locking mechanisms on these prior art clamps are in the neutral position, clamping engagement of the work piece is dependent on the gravitational force on the work piece. A sharp blow or bump to the steel plate can cause a temporary loss of tension on the lifting shackle thereby disengaging the gripping cam from the plate and causing the clamp to release and drop the plate.

The locking mechanism on most of these clamps is a single device that is directly connected to the linkage operating the gripping cam. It is this device that permits the locking mechanism to be shifted into the neutral position while the clamp is being suspended from its lifting shackle and carrying a steel plate. Under normal operating conditions, such clamps are relatively safe if the operator diligently adheres to the safety instructions that are provided by the manufacturer of the clamp. Unfortunately, serious accidents occur because the operators ignore these safety instructions and shift the locking mechanism to the neutral position while the clamp is under load. One of the principal reasons that these safety instructions are ignored is that the locking mechanism of the clamp cannot be unlocked and locked open from a remote location. When the clamp is used to lift a plate to a high location, often the operator will place the locking mechanism in the neutral position after lifting the plate and before raising the plate to the high location, thereby avoiding having to climb up to the clamp to unlock its locking mechanism. Further, in some cases, after the worker has climbed up to the clamp's position to release the clamp, the worker must also lift the clamp off the steel plate.

Thus, the lifting clamps of the locking and unlocking type have serious deficiencies. The prior art clamps cannot be locked open or locked closed from a remote position below the clamp. The locking and unlocking mechanisms of the clamp are directly connected to each other and, in some cases, also connected to the linkage operating the gripping cam. Movement of the cam linkage, such as by a sharp blow, to the open position while the locking mechanism is in the neutral position, can cause the locking mechanism to lock the cam in the open position. The locking mechanisms of the prior art clamps have a neutral position which creates an unsafe condition.

It is an object of the present invention to overcome these deficiencies of the prior art. In particular, the present invention eliminates the neutral position of the locking mechanism of the clamp, the locking and unlocking mechanisms of the present invention being completely independent. The clamp of the present invention may be remotely actuated to release the clamp thereby eliminating the need for operators to climb up to the clamp. Further, the clamp of the present invention cannot be unlocked or opened while there is tension on the lifting shackle.

Other objects and advantages of the present invention will appear from the following description.

SUMMARY OF THE INVENTION

The plate lifting clamp of the present invention includes linkage disposed on the clamp with one end of the linkage connected to the lifting shackle and the other end of the linkage connected to a cam rotatably mounted on the clamp. Upon the application of a force on the lifting shackle by the hoist, the linkage causes the cam to rotate against the work piece gripping the work piece between the cam and a swivel pad mounted on the clamp. An operating handle is rotatably disposed on the clamp whereby when rotated to the open position, will cause the cam to rotate away from the work piece and open the clamp. A spring biased locking pin mechanism is provided on the clamp to lock the operating handle into the open position. A spring on the linkage maintains the cam in the closed position.

The plate lifting clamp of the present invention includes the following advantages:

(1) The locking and unlocking mechanisms are completely independent of each other.

(2) The plate lifting clamp does not have a neutral position in the locking and unlocking mechanisms.

(3) The clamp can be locked open or locked closed from a remote position.

(4) The clamp unlocking mechanism cannot be placed in neutral or opened when the clamp is being suspended from its lifting shackle.

(5) The clamp can be released and locked open only when the load and the clamp body are resting on a solid object and there is no tension on the clamp lifting shackle.

(6) When the clamp is being suspended from its lifting shackle, the operating arm cannot be shifted to open the cam linkage or shifted to a neutral position since there is no neutral position.

BRIEF DESCRIPTION OF THE DRAWINGS

For a detailed description of a preferred embodiment of the invention, reference will not be made to the accompanying drawings wherein.

DESCRIPTION OF THE PREFERRED EMBODIMENT

Figure 1:
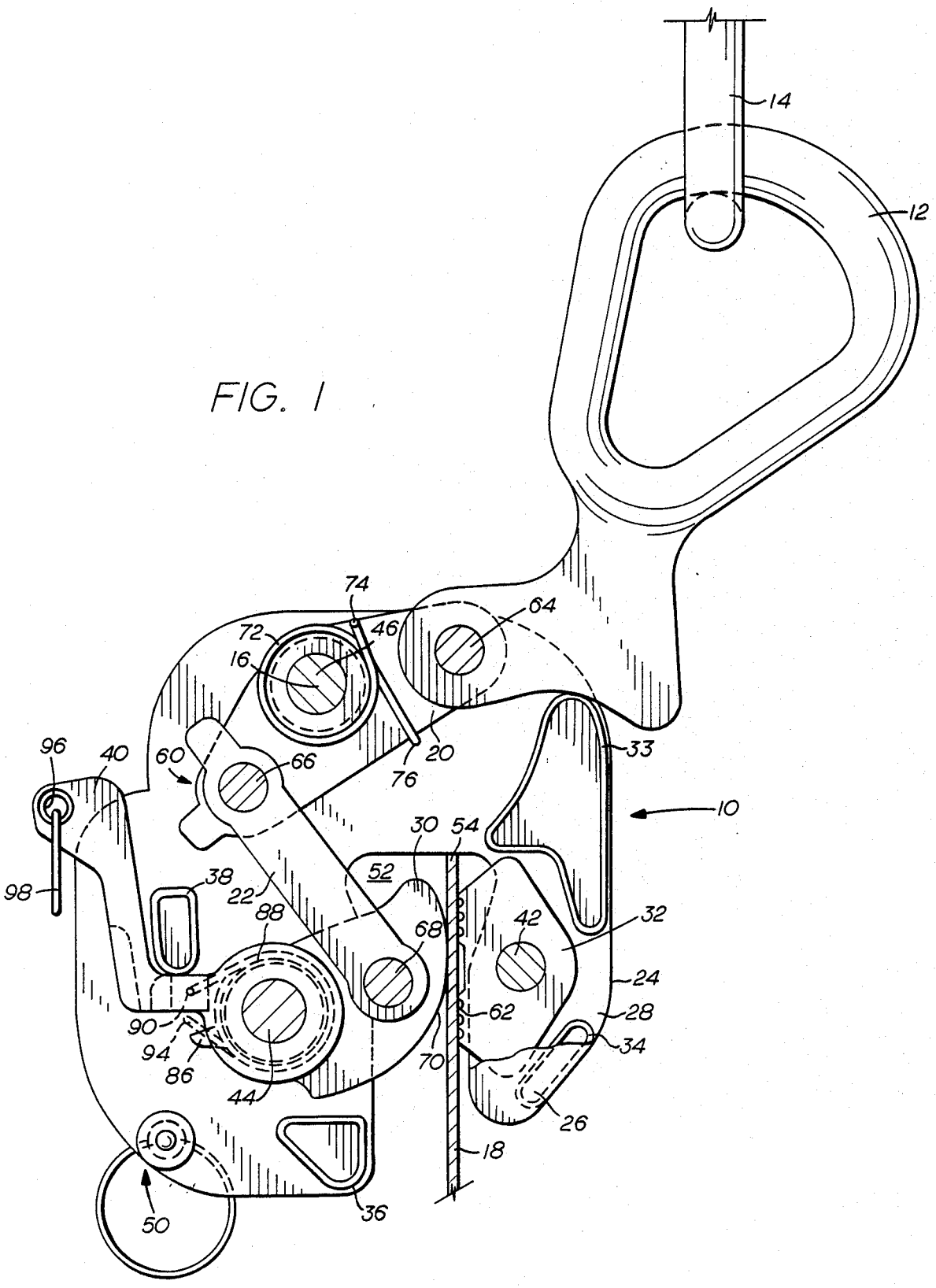
FIG. 1 is a side elevation view of the clamp of the present invention in the closed position.

Referring initially to FIG. 1, the plate lifting clamp 10 of the present invention lifts a work piece, such as a steel plate 18, using a hoist hook 14 connected to the shackle 12 of the clamp 10. A spring-biased radius arm 20 pivots around pivot point 16 causing a connecting arm 22 to exert a downward force on a jaw or gripping cam 30. The spring 72, together with the gravitational force caused by the weight of the steel plate 18 on the shackle 12, applies a downward force which causes the cam 30 to rotate into the steel plate 18 to be lifted by hoist hook 14. This rotation into the plate 18 forces the plate 18 against another jaw or swiveling pad 32 to grip the steel plate 18 between the cam 30 and the swiveling pad 32. The force of the cam 30 against the plate 18, which in turn is pressed against the swiveling pad 32, causes the lifting clamp 10 to grip the steel plate 18. With the clamp 10 in the closed position, as the hoist raises the clamp 10 and steel plate 18 on the shackle 12, the weight of the steel plate 18 causes the cam 30 to rotate further into the steel plate 18 with a force dependent upon the weight of the steel plate 18. In this manner, the lifting clamp 10 connects the steel plate 18 to the hoist hook 14 whereby the hoist (not shown) is used to lift the heavy steel plate 18 for transport.

An operating arm 40 is engageable with the cam 30 whereby as the operating arm 40 is rotated counterclockwise from a retracted or relaxed position to an open locked position, the operating arm 40 will cause the cam 30 to also rotate counterclockwise away from gripping engagement with the plate 18. After the operating arm 40 and the cam 30 have been rotated into the open position, the operating arm 40, and thus the clamp 10, is locked into the open position by a pin mechanism 50.

The body 24 of plate lifting clamp 10 includes two facing shells or sides 26, 28 separated by a plurality of spacers 33, 34, 36, and 38 which are configured and positioned to also serve as stops to the movement of various parts of the clamp as hereinafter described. Such spacers, together with sides 26, 28, form an interior for housing the operating mechanisms of the clamp 10. The spacers 33, 34, 36 and 38 are forged with the sides 26, 28 of the clamp body 24, and project from each of the sides 26, 28 for attachment by welding so as to connect the sides 26, 28 of the clamp body 24.

Plate lifting clamp 10 includes an opening or slot 52 formed by the sides 26, 28 for receiving an edge 54 of work piece or steel plate 18 to be attached to the hoist nook 14. The plate 18 is affixed to the clamp 10 by the frictional engagement of the swiveling pad 32, rotatably mounted on a swivel pad pin 42 located on one side of slot 52, and the cam 30, rotatably mounted on the cam pin 44 disposed on the other side of slot 52. The pins 42, 44 extend between the clamp sides 26, 28, passing through apertures in the swiveling pad 32 and the cam 30, respectively, to permit a swiveling and rotating movement thereon. The pins 42, 44 project through the apertures and are held in place by cotter keys (not shown). The swiveling pad 32 is limited in its rotational movement by the spacer stops 33, 34 which are positioned to engage the swiveling pad 32 so as to position the swiveling pad 32 for proper gripping engagement with the steel plate 18. Serrations or teeth 62 are provided on the face of the swiveling pad 32 to insure frictional engagement of the clamp 10 with the plate 18. As the cam 30 rotates into engagement with one side of the plate 18, swiveling pad 32 rotates with the movement of the plate 18 within the slot 52 so as to permit full contact with the work piece 18 at all times.

The cam 30 is rotated into frictional engagement with the plate 18 by means of linkage 60 connecting the cam 30 with the shackle 12 and the spring 72 biasing linkage 60, and thus the cam 30, toward the closed position whereby as the weight of the plate 18 is applied to the shackle 12, the shackle 12, by means of the linkage 60, increases the camming force of the cam 30 on the plate 18.

The linkage 60 includes a radius link or arm 20 pivotally mounted on the radius arm pin 46. The link pin 46 extends between the clamp sides 26, 28 through an aperture in the radius arm 20 and is held in place by cotter keys (not shown). One end of the radius arm 20 is rotatably connected to one end of the shackle 12 by a linkage rivet 64 extending through mating apertures in the shackle 12 and the radius arm 20. The other end of radius arm 20 is rotatably attached to the connecting link or arm 22. The connecting arm 22 links radius arm 20 with the cam 30. Linkage rivets 66, 68 extend between mating apertures in connecting arm 22 and radius arm 20 and in connecting arm 22 and the cam 30 to permit relative rotation therebetween. The linkage rivet 68, affixed to the cam 30, is spaced apart from the rotation point of cam pin 44 to provide leverage of the cam 30 against the plate 18 as force is applied to the cam 30 through the connecting arm 22. The cam 30 includes a camming surface 70 which cams into frictional engagement with the plate 18 as the force is applied to the cam 30 by linkage 60 thereby biasing the plate 18 between camming face 70 and the teeth 62.

Figure 2:
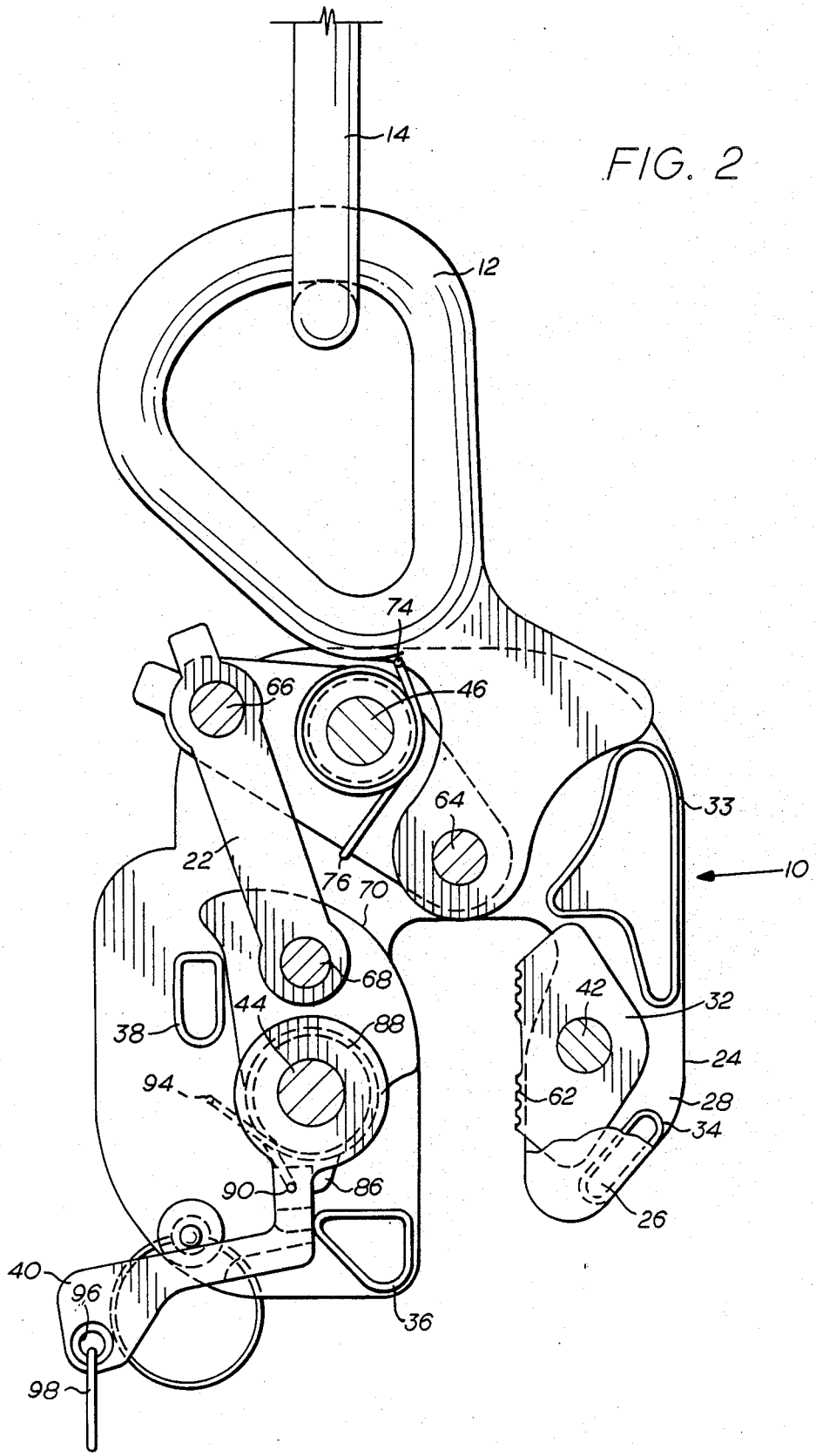
FIG. 2 is a side elevation view of the clamp of the present invention in the open position.

A coiled spring 72 is disposed around radius arm pin 46 with the ends 74, and 76 of the spring 72 inserted through apertures in the sides 26, 28 of clamp 10. The spring 72 is wrapped around radius arm 20 so as to apply a counterclockwise bearing force to the radius arm 20. The spring 72 is coiled as the radius arm 20 is rotated clockwise and as the clamp is opened as shown in FIG. 2. Upon unlocking the clamp 10 from the open position, the spring 72, applying a counterclockwise rotational force on the radius arm 20, causes radius arm 20 to rotate counterclockwise moving the linkage 60, and thus the clamp 10, to the closed position shown in FIG. 1. The spring tension applied by the spring 72 varies with the size of the clamp 10 but is sufficient to maintain a force on the linkage 60 and thus the cam 30 to maintain the clamp 10 in the closed position. Thus, in operation, as the spring 72 and the shackle 12 provide a counterclockwise rotational force on the radius arm 20, the opposite end of the radius arm 20 applies a clockwise rotational force on the cam 30 by means of the connecting arm 22 to cause the cam 30 to rotate clockwise against the plate 18.

Figure 7:
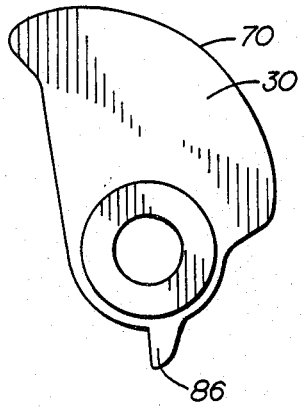
FIG. 7 is an elevation view of the cam of the clamp shown in FIGS. 1 and 2.
Figure 5:
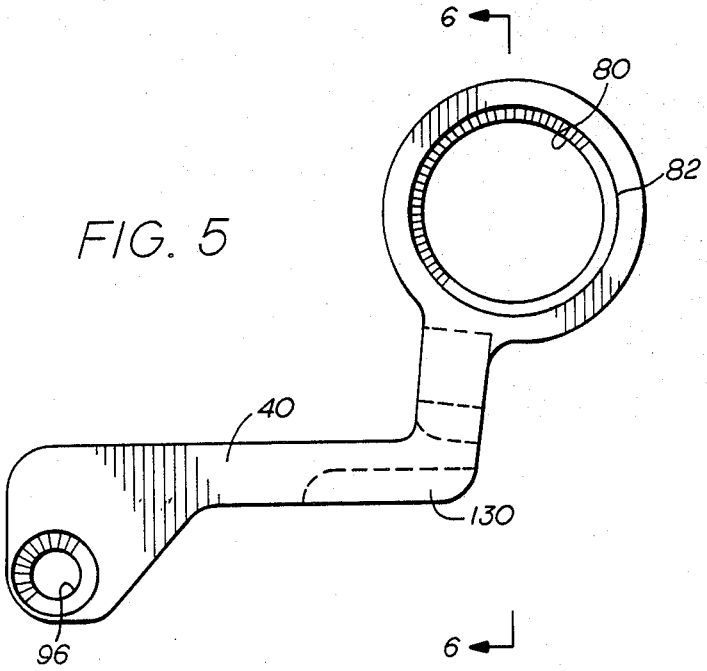
FIG. 5 is a side view of the operating handle shown in FIGS. 1 and 2.
Figure 6:
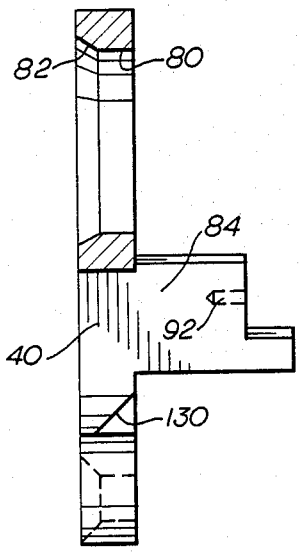
FIG. 6 is a cross section of the operating handle shown at plane 6—6 in FIG. 5.

The operating arm or handle 40 is provided to disengage the cam 30 from the plate 18 and open the clamp 10. Referring now to FIGS. 5 and 6, the operating handle 40 is generally S-shaped with one end having an aperture 80 therethrough and the aperture 80 having a chamfered side 82 riding in a boss (not shown) projecting from the side 26 of the clamp 10. Cam pin 44 passes through the aperture 80 for rotating the operating arm 40 with respect to the cam 30. The operating arm 40 includes a projecting midportion 84 normal to the side of the clamp 10. As shown in FIG. 7, an ear or dog 86 is provided on cam 30 opposite camming surface 70.

The projecting midportion 84 of operating arm 40 is positioned to engage the dog 86 as the operating arm 40 is rotated counterclockwise in a direction opposite the clockwise rotation of the cam 30 as it engages the plate 18. As midportion 84 engages the dog 86, a counterclockwise force is applied to the cam 30 such that the cam 30 rotates away from the plate 18 to open the clamp 10.

A spring 88, shown in FIG. 1, is disposed around cam pin 44 with one end 90 received into bore 92 of the midportion 84 of operating arm 40, and the other end 94 of the spring 88 affixed to the clamp side 28. As the operating arm 40 is moved in a counterclockwise direction to open the clamp 10, the spring 88 is coiled as shown in FIG. 2 to subsequently assist the return of the operating arm 40 to its relaxed and retracted position as shown in FIG. 1. Spacer stop 38 limits the movement of the operating arm 40 to its relaxed or retracted position, and spacer stop 36 limits the movement of the operating arm 40 in the open locked position as shown in FIG. 2. The thickness of the steel plate 18 may be so great as to limit the clockwise rotation of the cam 30 and thus the rotation of the dog 86 against midportion 84 of the operating arm 40. The spring 88 insures that the operating arm 40 fully rotates against the spacer stop 38 to prevent the end of operation arm 40 from projecting away from the clamp 10 in its relaxed or retracted position. The opposite end of operating arm 40 includes an aperture 96 for receiving a pulling ring 98 to assist the operator in rotating the operating arm 40 to open the clamp 10. The pulling ring 98 facilitates the engagement of operating arm 40 by a hook on a pole or extension or lanyard (not shown) to rotate the arm 40 from a remote position.

Figure 3:
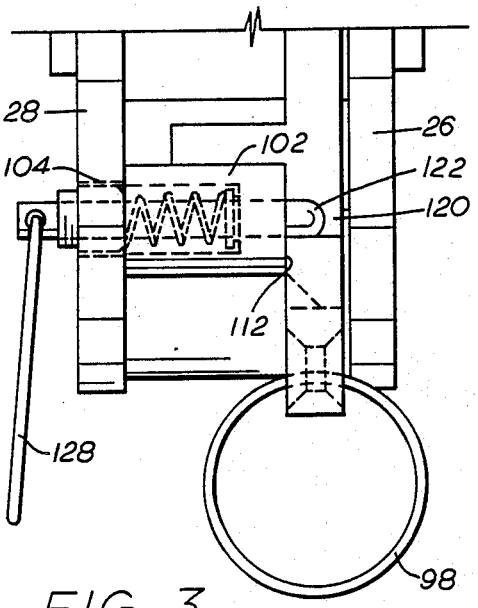
FIG. 3 is a partial end view of the clamp of FIG. 2 showing the spring pin assembly.
Figure 4:
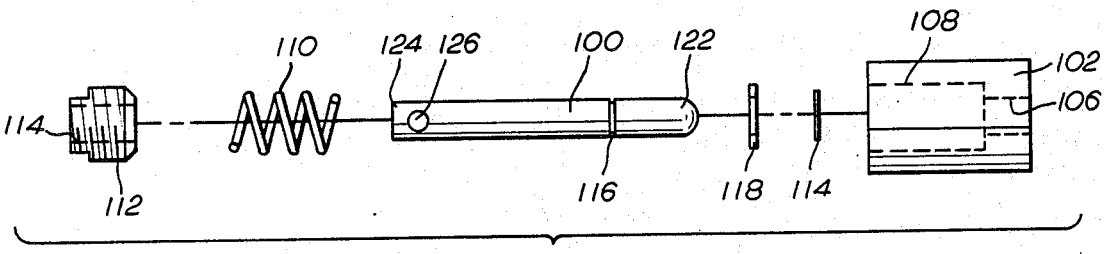
FIG. 4 is an exploded view of the spring assembly shown in FIG. 3.

Referring now to FIGS. 3 and 4, there is shown the locking pin mechanism 50 for locking the clamp 10 in the open position. The locking pin mechanism 50 includes a housing 102 affixed to the inner surface of the clamp side 28 by welding and aligned with a threaded aperture 104 therethrough. Housing 102 includes a throughbore 106 for receiving the locking pin 100 and a counterbore 108 for receiving the locking spring 110. As shown in FIG. 3, the locking pin 100 extends from outside of the clamp side 28 through bore 106 and into the space or clearance 120 between the inner side of the clamp side 26 and the end of housing 102. The operating arm 40 is positioned on the cam pin 44 between the clamp sides 26, 28 so as to pass through the space or clearance 120. Thus, when protruding into the space 120, the locking pin 100 will engage the operating arm 40 as hereinafter described.

Referring again to FIG. 4, locking pin 100 is assembled within housing 102 with a snap ring 114 disposed in an annular ring groove 116 at a predetermined position on pin 100 whereby the snap ring 114 will limit the downward movement of locking pin 100 in counterbore 108 of housing 102. Thus, snap ring 114 and groove 116 determine the extent to which locking pin 100 protrudes into the clearance 120. A washer 118 is disposed around locking pin 100 within counterbore 108 to provide a bearing surface for one end of the spring 110. A retaining bushing 112, having an aperture 114 therethrough for locking pin 100, threadingly engages the threaded aperture 104 of the clamp side 28. The inner end of retaining bushing 112 provides the upper bearing surface for the other end of the spring 110.

Spring 110 forces the locking pin 100 through the housing 102 causing it to protrude into the clearance 120. The protruding end 122 of the pin 100 is rounded to facilitate engagement with operating arm 40. As best shown in FIG. 2, the locking pin 100 locks operating arm 40, and thus clamp 10, in the open position by capturing the arm 40 between pin 100 and spacer stop 36 and preventing the arm 40 from rotating- clockwise into its relaxed or retracted position. The other opposite end 124 of the locking pin 100 extends out of the aperture 104 and includes a bore 126 therethrough to receive a pulling ring 128 whereby locking pin 100 can be retracted from clearance 120 and into the housing 102 to clear the path of movement of the operating arm 40 through clearance 120. By retracting pin 100 using pulling ring 128, the spring 88 will move operating arm 40 clockwise to its upper relaxed or retracted position shown in FIG. 1. Operating arm 40 includes a cam surface 130 which engages the rounded end 122 of locking pin 100 to automatically retract locking pin 100 as the operating arm 40 is moved from its upper relaxed or retracted position to its lower open and locked position.

In operation, the clamp 10 is suspended from the hoist hook 14 by the shackle 12. With its operating arm 40 in its lower open and locked position, the clamp 10 is maintained in the open position by the locking pin 100 with the linkage 60 and the cam 30 positioned as shown in FIG. 2. A steel plate or other work piece 18 is inserted into the slot 52 of the clamp 10. The clamp 10 is placed over the edge 54 of the plate 10. When the plate 18 is in position within slot 52, a pulling force is applied to ring 128 to retract the spring-loaded locking pin 100. This permits the operating arm 40 to rotate to its upper relaxed or retracted position with the clamp 10 in the closed position shown in FIGURE 1. A hook (not shown) may be used to hook the ring 128, located on the end of the spring-loaded pin 100, and retract the pin 100. This clockwise rotation of the operating arm 40 into its upper relaxed or retracted position permits the cam 30 to rotate clockwise against the plate 18 initially due to the bias of the spring 72 and then further rotate as the weight of the plate 18 is applied to the shackle 12. The clamp 10 then frictionally engages and grips the plate 18 between the camming face 70 and the pad 32. The upward force on the shackle 12 causes, by means of the linkage 60, the cam 30 to rotate clockwise into the plate 18 with a force dependent upon the weight of the plate 18.

When the weight of the plate 18 has been taken off the shackle 12 by putting the plate 18 at rest, a pole and hook (not shown) may be used to grab the ring 98 on the operating arm 40. A downward force on the operating arm 40 will cause the cam 30 to rotate and move away from the plate 18 whereby releasing the frictional engagement between the clamp 10 and the plate 18. After the operating arm 40 has been rotated under the spring loaded locking pin 100, the clamp 10 is in the open and locked position as shown in FIG. 2.

While a preferred embodiment of the invention has been shown and described, modifications thereof can be made by one skilled in the art without departing from the spirit of the invention.

What is claimed:

1. A clamp for a work piece, comprising:

a body having opposing jaws for gripping the work piece therebetween;

linkage disposed on said body for rotating at least one of said jaws between an open position where said one of said jaws does not engage the work piece and a closed position where said one of said jaws does engage the work piece;

an operating member rotatably disposed on said body and engageable with said one of said jaws, said member being rotatable between a retracted position where said member does not engage said one of said jaws and an engaged position where said member engages said one of said jaws;

means for biasing said operating member to said retracted position;

locking means for positively locking said operating member in said engaged position and preventing said operating member from rotating to said retracted position by said biasing means; and said operating member rotating said one of said jaws to said open position and actuating said locking means to positively lock said operating member in said engaged position as said operating member is rotated to said engaged position.

2. The clamp of claim 1 wherein said lock means includes a pin reciprocally mounted on said body.

3. A clamp for a work piece, comprising:

a body having opposing jaws for gripping the work piece therebetween;

linkage disposed on said body for rotating at least one of said jaws between an open position where one of said jaws does not engage the work piece and a closed position where said one of said jaws does engage the work piece;

an operating member rotatably disposed on said body and engageable with said one of said jaws, said member being rotatable between a retracted position where said member does not engage said one of said jaws and an engaged position where said member engages said one of said jaws;

said operating member rotating said one of said jaws to said open position as said operating member is rotated to said engaged position;

a lock means for locking said operating member in said engaged position and preventing said operating member from rotating to said retracted position;

said lock means including a pin reciprocally mounted on said body; and said operating member including cam means engageable with said pin to retract said pin upon rotation of said operating member from said retracted position to said engaged position.

4. A clamp for a work piece, comprising:

a body having opposing jaws for gripping the work piece therebetween;

linkage disposed on said body for rotating at least one of said jaws between an open position where one of said jaws does not engage the work piece and a closed position where said one of said jaws does engage the work piece;

an operating member rotatably disposed on said body and engageable with said one of said jaws, said member being rotatable between a retracted position where said member does not engage said one of said jaws and an engaged position where said member engages said one of said jaws;

said operating member rotating said one of said jaws to said open position as said operating member is rotated to said engaged position;

said operating member including a projecting portion which engages a dog on said one of said jaws causing said one of said jaws to rotate to said open position as said operating member rotates to said engaged position.

5. A clamp for attaching a work piece to a hoist, comprising:

a body having a pad adapted for engaging the work piece;

linkage disposed on said body;

a shackle attached to one end of said linkage and adapted for attachment to the hoist;

a cam attached to another end of said linkage and rotatably mounted on said body;

said linkage rotating said cam into a closed position toward said pad upon the application of a force on said shackle by the hoist whereby the work piece is gripped between a gripping surface on said cam and said pad;

a handle rotatably disposed on said body and engageable with said cam upon rotation of said handle from a relaxed to an open position whereby said cam is rotated away from said pad and the work piece is released from the clamp;

means for biasing said handle toward said relaxed position; and locking means for positively locking said handle in said open position, said locking means being actuated by said handle as said handle rotates to said open position.

6. The clamp of claim 5 wherein said handle includes means for actuating said handle from a remote location.

7. The clamp of claim 5 wherein said body includes stops to limit the movement of said handle.

8. A clamp for attaching a work piece to a hoist, comprising:

a body having a pad adapted for engaging the work piece;

linkage disposed on said body;

a shackle attached to one end of said linkage and adapted for attachment to the hoist;

a cam attached to another end of said linkage and rotatably mounted on said body;

said linkage rotating said cam into a closed position toward said pad upon the application of a force on said shackle by the hoist whereby the work piece is gripped between said cam and pad;

a handle rotatably disposed on said body and engageable with said cam upon rotation of said handle from a relaxed to an open position whereby said cam is rotated away from said pad and the work piece is released from the clamp;

said handle and said cam having coinciding pivot points on said body.

9. A clamp for attaching a work piece to a hoist, comprising:

a body having a pad adapted for engaging the work piece;

linkage disposed on said body;

a shackle attached to one end of said linkage and adapted for attachment to the hoist;

a cam attached to another end of said linkage and rotatably mounted on said body;

said linkage rotating said cam into a closed position toward said pad upon the application of a force on said shackle by the hoist whereby the work piece is gripped between a gripping surface on said cam and said pad;

a handle rotatably disposed on said body and engageable with said cam upon rotation of said handle from a relaxed to an open position whereby said cam is rotated away from said pad and the work piece is released from the clamp;

said cam including an ear opposite said gripping surface whereby said handle engages said ear to rotate said cam away from the work piece.

10. A clamp for attaching a work piece to a hoist, comprising:

a body having a pad adapted for engaging the work piece;

linkage disposed on said body;

a shackle attached to one end of said linkage and adapted for attachment to the hoist;

a cam attached to another end of said linkage and rotatably mounted on said body;

said linkage rotating said cam into a closed position toward said pad upon the application of a force on said shackle by the hoist whereby the work piece is gripped between said cam and pad;

a handle rotatably disposed on said body and engageable with said cam upon rotation of said handle from a relaxed to an open position whereby said cam is rotated away from said pad and the work piece is released from the clamp;

lock means for locking said handle in the open position; and said lock means including a pin engageable with said body and said handle to prevent the rotation of said handle from said open position to said relaxed position.

11. The clamp of claim 10 wherein said lock means further includes retractable biasing means for biasing said pin into a position on said body preventing the rotation of said handle into the relaxed position.

12. The clamp of claim 11 wherein said handle includes means for retracting said lock means as said handle is rotated into the open position.

* * * * *